US006665607B2

(12) United States Patent
Skala et al.

(10) Patent No.: US 6,665,607 B2
(45) Date of Patent: Dec. 16, 2003

(54) METHOD AND DEVICE FOR CONTROLLING AN INTERNAL COMBUSTION ENGINE

(75) Inventors: Peter Skala, Tamm (DE); Dirk Samuelsen, Ludwigsburg (DE); Ruediger Fehrmann, Leonberg (DE); Markus Jung, Stuttgart (DE); Gabriel Scolan, Chambray-lés-Tours (FR)

(73) Assignee: Robert Bosch GmbH, Stuttgart (DE)

( * ) Notice: Subject to any disclaimer, the term of this patent is extended or adjusted under 35 U.S.C. 154(b) by 119 days.

(21) Appl. No.: 09/922,887

(22) Filed: Aug. 6, 2001

(65) Prior Publication Data

US 2002/0120387 A1 Aug. 29, 2002

(30) Foreign Application Priority Data

Aug. 5, 2000 (DE) ..... 100 38 339

(51) Int. Cl.[7] ..... F02D 45/00

(52) U.S. Cl. ..... 701/114; 701/110; 701/102; 123/406.6

(58) Field of Search ..... 701/114, 110, 701/102, 101; 123/406.58, 406.6, 406.63, 406.64, 406.65

(56) References Cited

U.S. PATENT DOCUMENTS

| | | | | | |
|---|---|---|---|---|---|
| 4,204,171 | A | * | 5/1980 | Sutphin, Jr. | 327/557 |
| 4,527,523 | A | * | 7/1985 | Daumer et al. | 123/406.24 |
| 4,651,698 | A | * | 3/1987 | McDermott et al. | 123/406.35 |
| 4,664,083 | A | * | 5/1987 | Nix et al. | 123/406.35 |
| 4,674,459 | A | * | 6/1987 | Blocher et al. | 701/104 |
| 4,932,382 | A | * | 6/1990 | Fujimoto et al. | 123/488 |
| 5,005,425 | A | * | 4/1991 | Ohmae | 73/861.22 |
| 5,692,052 | A | * | 11/1997 | Tanaka et al. | 381/71.9 |

FOREIGN PATENT DOCUMENTS

| | | | | |
|---|---|---|---|---|
| DE | 195 27 218 | | 6/1996 | |
| JP | 8-61122 | * | 3/1996 | F02D/41/14 |

* cited by examiner

*Primary Examiner*—Hieu T. Vo
(74) *Attorney, Agent, or Firm*—Kenyon & Kenyon

(57) ABSTRACT

A method and a device are described for controlling an internal combustion engine. A manipulated variable is specifiable on the basis of at least one measured quantity. The measured quantity is filterable by at least one filter. An excitation variable is superimposed on the manipulated variable, and the properties of the filter are determined on the basis of the resulting reaction of the measured quantity.

10 Claims, 3 Drawing Sheets

METHOD AND DEVICE FOR CONTROLLING AN INTERNAL COMBUSTION ENGINE

FIELD OF THE INVENTION

The present invention relates to a method and a device for controlling an internal combustion engine.

BACKGROUND INFORMATION

Such a method and such a device for controlling an internal combustion engine are known from the German Published Patent Application No. 195 27 218. There, a method and a device are described for controlling the smooth running of an internal combustion engine. A manipulated variable can be preset on the basis of at least one measured quantity, which here is the speed of the internal combustion engine. To form the manipulated variable, the measured quantity is filtered by at least one filter means. Usually in the case of a smooth-running control, each cylinder of the internal combustion engine is assigned a control which, as a function of a system deviation allocated to it, forms a manipulated variable for the cylinder assigned to it. The system deviation is derived from the actual values and setpoint values allocated to the individual cylinders. The time intervals between two combustions or the duration of at least one segment, which is defined by a segmental wheel, are used as the actual value. The setpoint values are preferably yielded by an averaging using all actual values.

The spacing between two pulses on a so-called segmental wheel is usually designated as a segment. In this context, the interval between two combustions is generally divided into two segments. The segmental wheel can be placed on the camshaft or the crankshaft and delivers two pulses per combustion process. Alternatively, the segment pulses can also be generated on the basis of other signals.

The actual and setpoint values are preferably ascertained in a frequency-specific manner, i.e. the output signal of the speed sensor is filtered by band-pass filters, and the actual and setpoint values for a frequency are formed on the basis of this filtered signal. Provision is made to weight the amplification of the band-passes and/or the frequency-specific system deviation. These weighting factors are usually stipulated within the framework of the application. It is also provided that, to form the frequency-specific actual values for different frequencies and different vehicle types, different segments are selected which take into account the frequency-specific and vehicle-specific phase shifts between quantity oscillation and rotational-speed oscillation. Therefore, it is likewise established within the framework of the application, which segments are utilized for actual value formation and/or setpoint value formation.

Due to this stipulation of the segment selection and of the band-pass amplification, a considerable outlay results in the application.

SUMMARY OF THE INVENTION

Using the procedure of the present invention, the outlay can be markedly reduced in the application. In particular, the time expenditure and the requirement for measuring technology can be reduced, since no external measuring instruments are necessary.

Because an excitation variable is superimposed on the manipulated variable, and because properties of the filter means are determined on the basis of the resulting reaction of the measured quantity, the properties of the filter means can be adapted individually to the respective vehicle.

According to the present invention, the properties of the filter means are determined in preferred operating states. The determination is preferentially carried out at the end of the vehicle manufacture and/or within the framework of servicing the vehicle. Thus, the properties can be optimally selected over the entire service life of the vehicle.

It is particularly advantageous if the filter means are constructed as a band-pass filter with adjustable amplification. In this case, the band-pass amplification is adapted.

If the filter means ascertains an actual value and/or a setpoint value by evaluating specific rotational-speed segments, then this segment selection is designated as a property of the filter means.

The amplification and the segment selection determine the properties of a smooth-running control. The performance of the vehicle can be favorably influenced by a precise adaptation of these variables to the respective vehicle.

It is particularly advantageous if a periodic variable is used as excitation variable whose frequency corresponds to the crankshaft frequency, the camshaft frequency and/or an integral multiple of these frequencies. These frequencies correspond to the disturbances generally occurring.

DETAILED DESCRIPTION

In the following, the procedure of the present invention is presented using a smooth-running control as an example. However, the procedure according to the present invention is not limited to this exemplary embodiment; it can also be used for other open-loop and/or closed-loop controls for internal combustion engines. It can be used in particular when a manipulated variable is specifiable starting from at least one measured quantity. If this manipulated variable acts upon the internal combustion engine, this results in a corresponding change in the measured quantity.

Figure 1:
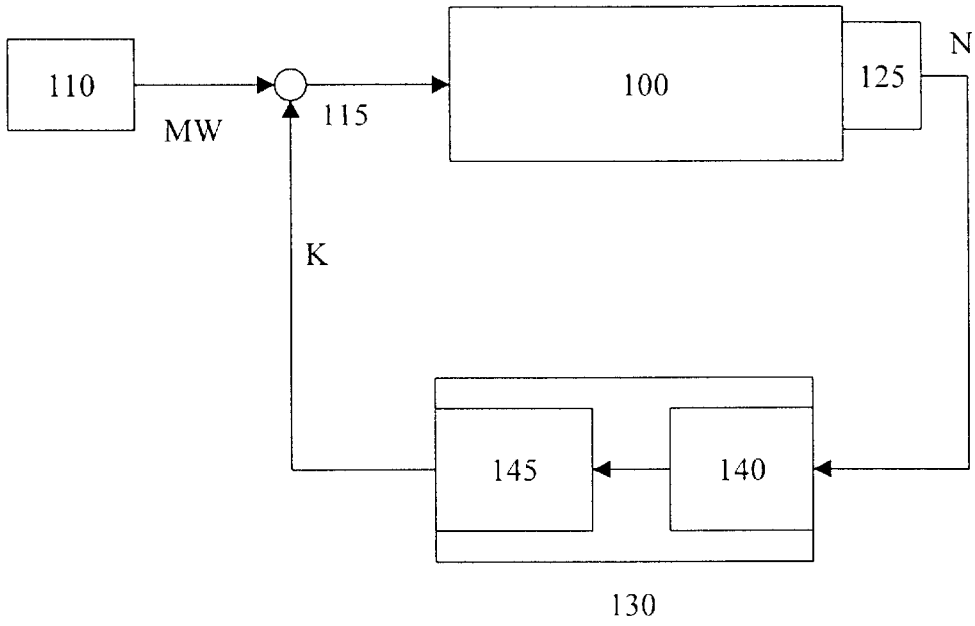
FIG. 1 shows a block diagram of the device according to the present invention.

FIG. 1, in a rough schematic fashion, shows a smooth-running control for an internal combustion engine as a block diagram. The internal combustion engine is designated by 100. A fuel-quantity-demand input 110 sends a fuel-quantity demand MW via a node 115 to a volume-flow controlling unit (not shown) of internal combustion engine 100. Speed N of the internal combustion engine is detected by a sensor 125. A corresponding signal arrives at a smooth-running control 130. The speed signal is evaluated by filtering 140 which then in turn applies a corresponding signal to a manipulated-variable determination element 145. Manipulated-variable determination element 145 determines a correction quantity K which is combined in node 115 with fuel-quantity demand MW.

Usually a fuel-quantity demand MW is determined by fuel-quantity-demand input 110 starting from the driver command which, for example, is acquired with an accelerator pedal. This variable or a variable corresponding to this variable is supplied to the volume-flow controlling unit of internal combustion engine 100, this volume-flow controlling unit then establishing the fuel quantity to be injected corresponding to this signal. Solenoid valves, piezoelectric actuators or other actuators are generally used as volume-flow controlling unit, which establish the start of injection, the end of injection and thus also the injection quantity as a function of their trigger signal.

It is usually desired that all cylinders of an internal combustion engine contribute the same torque to the total torque. Because of tolerances, the individual cylinders contribute differently to the total torque in response to the same trigger signal. To compensate for this, a smooth-running control is provided which, on the basis of the speed signal, provides a suitable correction value K that is determined such that all cylinders contribute the same torque to the total torque.

To this end, as presented in the related art, a cylinder-specific actual value and setpoint value are calculated on the basis of the speed value, and the actual value is adjusted to the setpoint value. A suitable filtering 140 is shown in detail in FIG. 2.

The filter means preferably includes at least one band-pass with adjustable amplification. Furthermore, filter means 140 determines at least one actual value and/or at least one setpoint value by evaluating specific segments of a speed signal. The properties of the filter means are determined by the amplification of the band-pass and the segments which are utilized for forming the actual values and/or setpoint values.

Figure 2:
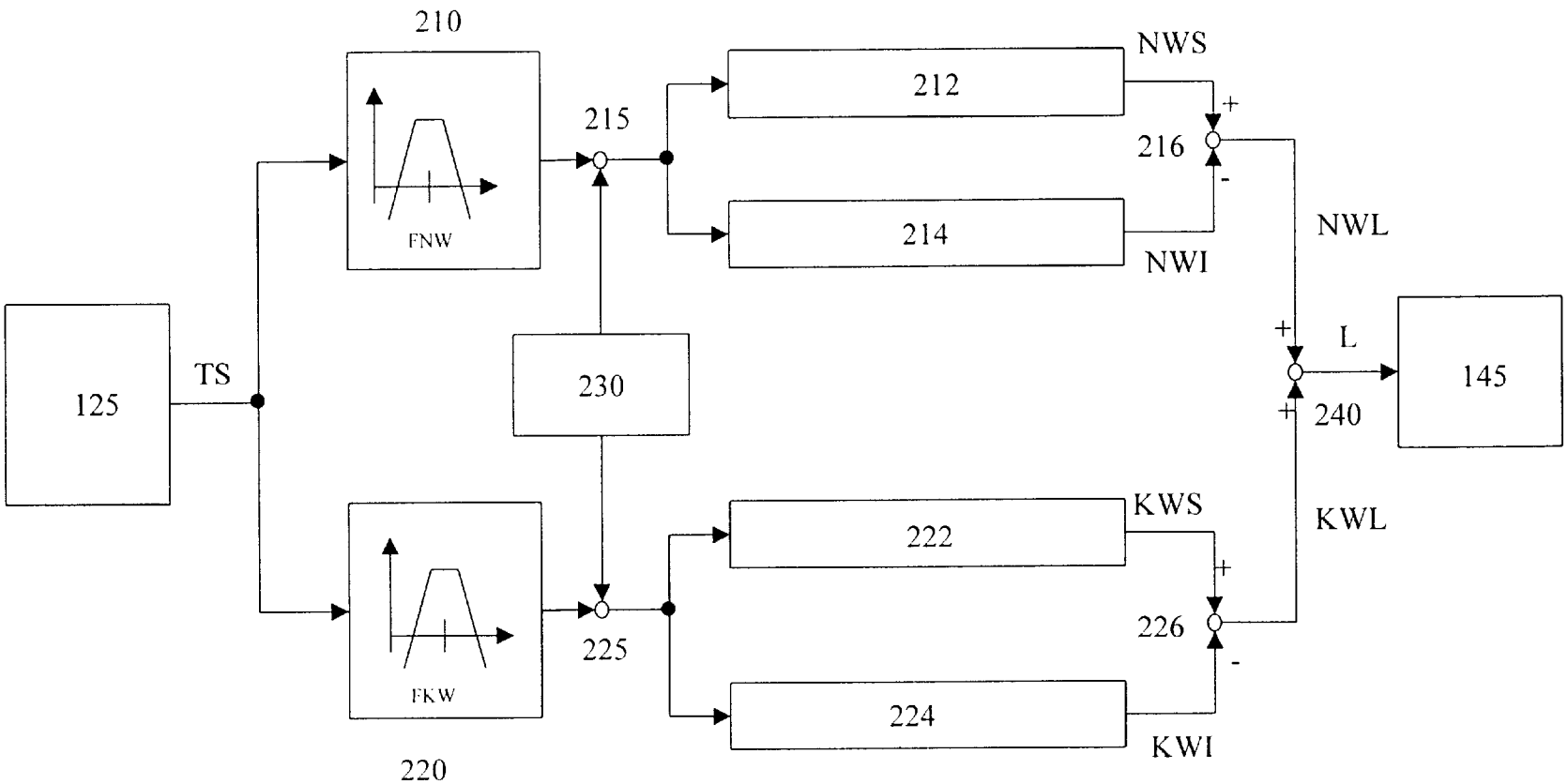
FIG. 2 shows a detailed representation as a block diagram of the actual-value determination.

FIG. 2 shows actual-value determination 140 in detail. Elements already described in FIG. 1 are marked with corresponding reference numerals in FIG. 2. The output signal of sensor 125 is supplied to a first filter 210 and a second filter 220. The output signal of first filter 210 arrives, via a node 215, at a first setpoint-value determination element 212 and a first actual-value determination element 214. The output signal of second filter 220 arrives, via a node 225, at a second setpoint-value determination 222 and a second actual-value determination 224.

An amplification-factor input 230 applies a specifiable amplification factor to each node 215 and 225. The output variables of band-passes 210 and 220 are multiplicatively combined with this amplification factor. In this manner, it is possible to implement band-passes with adjustable amplification.

Output signal NWS of first setpoint-value determination 212 arrives with a positive algebraic sign, and output signal NWI of first actual-value determination 214 arrives with a negative algebraic sign, at a node 216. First system deviation NWL arrives at a summing point 240, and from there at block 145.

Output signal KWS of second setpoint-value determination 222 arrives with a positive algebraic sign, and output signal KWI of second actual-value determination 224 arrives with a negative algebraic sign, at a node 226. Second system deviation KWL arrives at summing point 240.

Available at the output of summing point 240 is system deviation L which is routed to manipulated-variable determination 145 that contains the actual smooth-running regulator.

In the specific embodiment shown of an internal combustion engine having four cylinders, filters 210 and 220 are band-pass filters whose mid-frequency in the case of filter 210 lies at the camshaft frequency, and in the case of filter 220 lies at the crankshaft frequency. In refinements of the present invention, still further filters can be provided having integral multiples of the crankshaft frequency and/or the camshaft frequency.

In particular in the case of an internal combustion engine having 2*1 cylinders, 1 being a natural number, 1 band-passes can be provided whose mid-frequencies lie at an integral multiple of the camshaft frequency.

The speed signal is divided into spectral components by band-passes 210 and 220. The first, second and third actual-value calculators and the first, second and third setpoint-value calculators ascertain frequency-specific setpoint and actual values for each spectral component. The setpoint and actual values are preferably calculated differently for the individual spectral components.

The speed signal is divided for the individual frequencies by band-passes 210 and 220. First actual-value input 214 and second actual-value input 224 calculate a frequency-specific actual value for each frequency. Correspondingly, it can be provided that first setpoint-value input 212 and second setpoint-value determination 220 calculate a frequency-specific setpoint value for each frequency.

Alternatively to the adjustable amplification of band-passes 210 and 220, provision can also be made for the frequency-specific system deviations to be weightable by weighting factors. The weighting factors and/or the amplification of the band-passes is/are selected such that the closed-control-loop amplification is identical for all frequencies.

The segment selection is preferably carried out in a frequency-specific manner. This means different segments are utilized for calculating the actual values and/or the setpoint values for the individual frequencies. The frequency-specific system deviation is then ascertained in nodes 216 and 226. Furthermore, the segment selection can be preset nearly arbitrarily.

In the related art, the properties of the filter means are ascertained within the framework of the application and stored in the control unit. These application quantities are no longer corrected. As a result, the smooth-running control no longer operates optimally due to the effects of ageing.

Therefore, according to the present invention, the properties of the filter means, which in the following are also designated as control parameters, are adapted. This holds true in particular for the amplification of the band-passes and for the segment selection. To that end, the procedure of the present invention is as follows.

The allocation of a rotational-speed reaction to the causative cylinder is crucial for the functioning of the smooth-running control. Namely, this cylinder should receive more or less fuel quantity accordingly. The allocation can be determined from the frequency response characteristic. The phase shift between fuel quantity and speed is decisive for the frequency response characteristic. The segments into which the reaction falls are calculated on the basis of the phase shift. These segments are evaluated for forming the actual values. Actual-value determinations 214 and 224 and/or setpoint-value determinations 212 and 222 evaluate the segments thus ascertained for forming the actual values and/or setpoint values. That is to say, the segment selection is calculated as a function of the phase shift of the controlled system.

For each frequency considered, one or more segments result into which the reaction following the injection falls. The segments are usually different for each frequency.

In certain operating states in which such an adaptation is possible, an excitation variable is superimposed on the manipulated variable that is applied to the fuel-quantity positioner. Preferably a periodic signal is superimposed on the fuel-quantity signal. This quantity excitation produces rotational-speed oscillations which have a similar effect as the tolerances of the system, i.e. rotational-speed oscillations occur. The response of internal combustion engine 100 can be determined on the basis of the quantity excitation and the resulting rotational-speed oscillations. The response of the internal combustion engine is defined by the phase shift and the controlled system gain.

Starting from the phase shift thus ascertained and the controlled system gain or the amplitude response, the control parameters are then calculated. They are basically the amplification of the band-passes and the segment selection.

Figure 3:
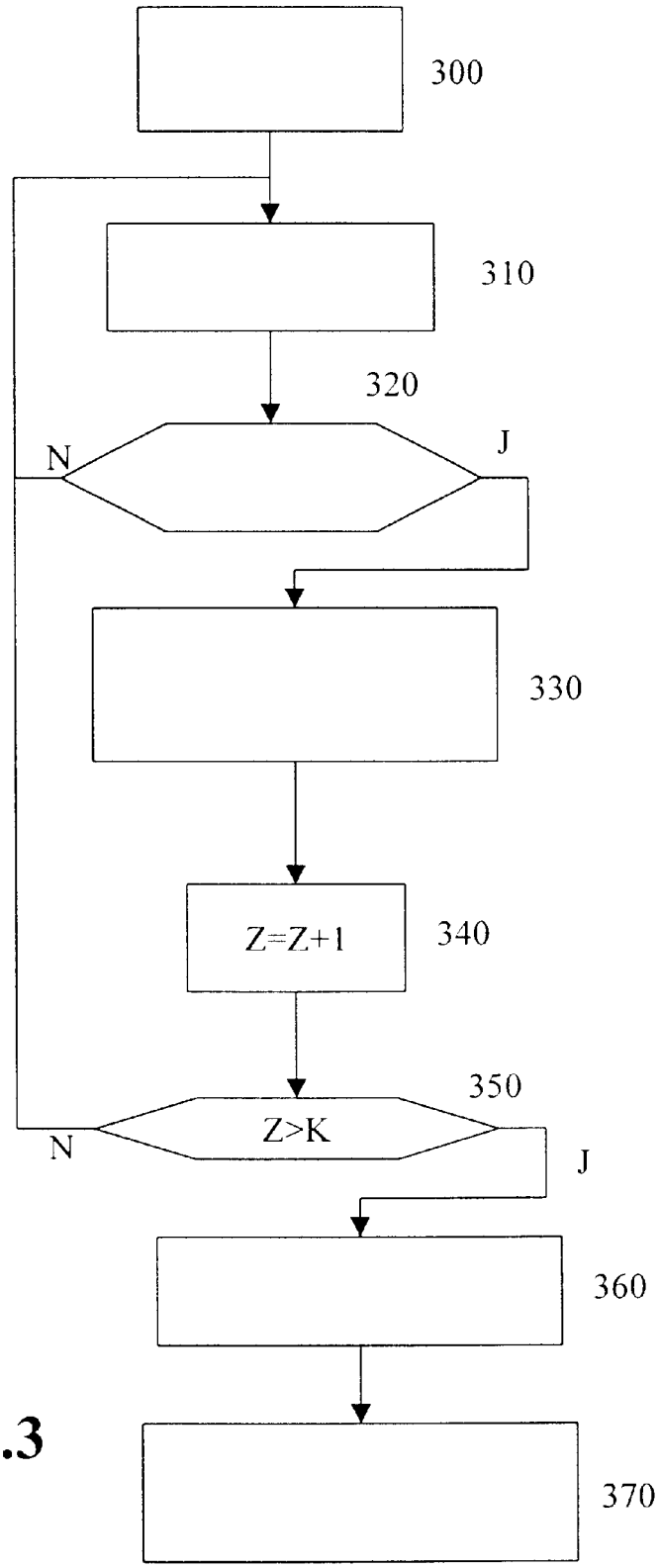
FIG. 3 shows a flow chart for the purpose of illustrating the procedure according to the present invention.

FIG. 3 shows a suitable procedure as a flow chart. In a first step 300, it is checked whether an operating state exists in which the adaptation can be carried out. It is particularly advantageous if the adaptation is triggered by external influences. Thus, the adaptation can preferably be carried out after the installation of the internal combustion engine during its first operation. It is also advantageous if the adaptation is carried out at regular intervals when the internal combustion engine, that is to say, the vehicle is serviced.

The normal operation of the internal combustion engine is not impeded during an adaptation at the end of the assembly line or within the framework of servicing. It is also possible to carry out the adaptation in certain stationary operating states such as in idle running.

If such an operating state is achieved, then in step 310, the quantity excitation is carried out, i.e. an additional signal is superimposed on fuel-quantity demand MW. By preference, this additional signal, also designated as excitation variable, is a periodic signal whose frequency preferably corresponds to the crankshaft frequency, the camshaft frequency and/or an integral multiple of these frequencies.

Subsequent query 320 checks whether a waiting time has elapsed since the quantity excitation in step 310. If this is not the case, the excitation variable continues to be superimposed on the fuel-quantity demand If the waiting time has elapsed, then the resulting rotational-speed oscillations are detected in step 330. In subsequent step 340, a counter Z is increased. Query 350 checks whether counter Z is greater than a value K. Value K corresponds to the number of the various quantity excitations.

If query 350 detects that number Z is greater than value K, i.e. various quantity excitations were implemented and the corresponding rotational-speed oscillations were detected, then in step 360, the response of the engine, which is determined in particular by the amplification, the amplitude response and the phase shift by the engine, is ascertained. The control parameters are ascertained in step 370 on the basis of these quantities.

This means that various quantity excitations are generated in succession and the corresponding engine speed is analyzed in order to determine the control parameters of the smooth-running control. In this context, the analysis phase is subdivided into a transient phenomenon, which is defined by the waiting time in step 320, in which the internal combustion engine and the operating parameters achieve stationary states again. The engine-speed amplitudes are subsequently measured. The controlled system gain and the phase shift, which are caused by the internal combustion engine, are calculated on the basis of the quantity excitation and the speed amplitude.

On the basis of these values for the controlled system gain and the phase shift, which can vary from internal combustion engine to internal combustion engine, smooth-running control 130 calculates the control parameters for the smooth-running control such as, in particular, the segment selection and the amplification of band-pass filters 210 and 220.

According to the present invention, the control unit independently ascertains the control parameters for the smooth-running control.

It is particularly advantageous that standard quantities can be used for the control parameters within the framework of the usual application, the standard quantities then being overwritten during the first operation of the internal combustion engine with values ascertained according to the present invention. Within the course of operation of the internal combustion engine, e.g. within the framework of servicing, ageing effects can be compensated by a new application. This means that application expenditure is sharply reduced, the accuracy of the data being markedly improved at the same time. In particular, ageing effects and deviations between internal combustion engines of the same type can be perceptibly reduced.

What is claimed is:

1. A device for controlling an internal combustion engine, a manipulated variable being specifiable on the basis of at least one measured quantity, comprising:

at least one filter for filtering a measured quantity; and an arrangement for superimposing an excitation variable on the manipulated variable and for determining a property of the at least one filter on the basis of a resulting reaction of the at least one measured quantity.

2. A method for controlling an internal combustion engine, comprising the steps of:

specifying a manipulated variable on the basis of at least one measured quantity;

filtering the at least one measured quantity by at least one filter;

superimposing an excitation variable on the manipulated variable; and determining a property of the at least one filter on the basis of a resulting reaction of the at least one measured quantity.

3. The method according to claim 2, wherein:

the property of the at least one filter is determined in a preferred operating state.

4. The method according to claim 2, wherein:

the at least one filter includes a band-pass filter with an adjustable amplification.

5. The method according to claim 4, wherein:

the property of the at least one filter is influenced by the adjustable amplification.

6. The method according to claim 2, wherein:

the at least one filter ascertains at least one of an actual value and a setpoint value by evaluating a specific rotational-speed segment.

7. The method according to claim 6, wherein:

the property of the at least one filter is influenced by the specific rotational-speed segment used for forming the at least one of the actual value and the setpoint value.

8. The method according to claim 6, wherein:

the excitation variable is a periodic quantity variable that has a frequency corresponding to at least one of a crankshaft frequency, a camshaft frequency, and an integral multiple of the crankshaft frequency and the camshaft frequency.

9. The method according to claim 2, wherein:

an amplification and a phase shift of a controlled system are determined on the basis of the excitation variable and a rotational-speed amplitude resulting therefrom.

10. The method according to claim 2, wherein:

the property of the at least one filter is determined on the basis of an amplification and a phase shift of a controlled system.

* * * * *